US005816460A

United States Patent [19]

Cook

[11] Patent Number: 5,816,460

[45] **Date of Patent: *Oct. 6, 1998**

[54] SHOULDER STRAP FOR SECURING A PURSE

[76] Inventor: Kim Maria Cook, 306 E. 83rd St., Apt. 2C, New York, N.Y. 10287

[ * ] Notice: The portion of the term of this patent subsequent to Oct. 29, 2010, has been disclaimed.

[21] Appl. No.: 727,788

[22] Filed: Oct. 7, 1996

Related U.S. Application Data

[63] Continuation-in-part of Ser. No. 28,075, Oct. 6, 1994, Pat. No. Des. 374,977.

[51] Int. Cl.[6] ..... A45F 3/02; A45F 3/04

[52] U.S. Cl. ..... 224/260; 224/583; 224/604; 224/605; 224/647

[58] Field of Search ..... 224/581, 582, 224/583, 165, 184, 191, 600, 687, 627, 638, 639, 641, 645–651, 663, 664, 665, 254, 255, 257, 258, 259, 260, 195, 272; 150/102

[56] References Cited

U.S. PATENT DOCUMENTS

| | | | |
|---|---|---|---|
| 43,539 | 7/1864 | Weston | 224/603 |
| 44,993 | 11/1864 | Woods . | |
| 67,800 | 8/1867 | Price | 224/272 |
| 79,761 | 7/1868 | Howell | 224/272 |
| 119,400 | 9/1871 | Penrose | 224/603 |
| 157,537 | 12/1874 | Palmer . | |
| 182,695 | 9/1876 | Oliver . | |
| 240,151 | 4/1881 | Lambert | 224/603 |
| D. 348,971 | 7/1994 | Jones . | |
| D. 374,977 | 10/1996 | Cook | D3/215 |
| 394,043 | 12/1888 | Whitlock | 150/102 |
| 707,610 | 8/1902 | Moeller . | |
| 1,178,628 | 4/1916 | Clawson . | |
| 1,207,154 | 12/1916 | Fox . | |
| 1,281,822 | 10/1918 | Orr . | |
| 1,445,400 | 2/1923 | Kisselhoff . | |
| 1,879,480 | 9/1932 | Pures . | |
| 2,018,606 | 10/1935 | Cumings | 224/641 |
| 2,089,402 | 8/1937 | Murray . | |
| 2,620,479 | 12/1952 | Buck . | |
| 2,625,192 | 1/1953 | Kinskie . | |
| 3,152,738 | 10/1964 | Worsfold, Jr. . | |
| 3,181,752 | 5/1965 | Seltzer et al. . | |
| 3,347,299 | 10/1967 | Alexander | 224/604 |
| 3,430,828 | 3/1969 | Gregson . | |
| 3,739,961 | 6/1973 | Soukeras . | |
| 3,796,357 | 3/1974 | Johnson . | |
| 4,327,852 | 5/1982 | Gibson . | |
| 4,485,276 | 11/1984 | Sato . | |
| 4,600,134 | 7/1986 | Colby . | |
| 4,750,652 | 6/1988 | Grant . | |
| 4,776,504 | 10/1988 | Panth . | |
| 4,785,984 | 11/1988 | Seitz-Gangemi . | |
| 5,016,797 | 5/1991 | Rowledge . | |
| 5,263,618 | 11/1993 | Talavera . | |
| 5,265,782 | 11/1993 | McNamara . | |
| 5,349,706 | 9/1994 | Keer | 224/582 |
| 5,358,159 | 10/1994 | Lundie, Jr. . | |
| 5,361,953 | 11/1994 | Nichols . | |
| 5,427,290 | 6/1995 | Thatcher | 224/660 |
| 5,497,923 | 3/1996 | Pearson et al. | 224/648 |

FOREIGN PATENT DOCUMENTS

| | | | |
|---|---|---|---|
| 2832 | of 1906 | United Kingdom | 224/216 |

*Primary Examiner*—Allan N. Shoap
*Assistant Examiner*—Gregory Vidovich
*Attorney, Agent, or Firm*—Barnes & Thornburg

[57] ABSTRACT

A device for securing and carrying an article such as a purse. The device includes a pair of shoulder straps which form at least one lower loop which passes beneath an arm of the wearer. A tether is provided on the lower loop. An object, such as a purse, to be secured and carried by the device is slidingly attached to the tether. In an alternative embodiment, the device includes a single shoulder strap that forms a loop which passes beneath an arm of a wearer.

11 Claims, 5 Drawing Sheets

SHOULDER STRAP FOR SECURING A PURSE

RELATED APPLICATIONS

The present Application is a continuation-in-part of U.S. patent application Ser. No. 29/028,075, filed Oct. 6, 1994 now U.S. Pat. Des. No. 374,977, the entire disclosure of which is hereby expressly incorporated by reference.

TECHNICAL FIELD

The present invention relates to an apparatus for securing and carrying articles and more particularly to a shoulder strap by which a purse can be carried and easily accessed.

BACKGROUND ART

There are numerous shoulder-wore devices which are designed to allow the wearer to carry various articles, including pouches, cameras, firearms, radios, etc. Examples of such devices include U.S. Pat. Nos. 5,016,797 to Rowledge, 4,785,984 to Seitz-Gangemi, 4,750,652 to Grant, 4,600,134 to Colby, 4,485,276 to Sato, 4,327,852 to Gibson, 3,739,961 to Soukeras, 3,181,752 to Seltzer et al., 3,152,738 to Worsfold, Jr., 1,879,480 to Pures, 182,695 to Oliver, 157,537 to Palmer, 1445,400 to Kisselhoff, 1,207,154 to Fox, 1,178,628 to Clawson, and 707,610 to Moeller.

Such devices commonly include one or more shoulder straps and various means, e.g. straps, hooks, etc., by which articles such as pouches, cameras, firearms, radios, etc. are attached to the straps. Most articles which are carried by such shoulder-worn devices are attached thereto at a fixed location. For example, pouches for holding money and other valuables are often positioned beneath an arm of the wearer so as to be concealed.

The present invention is directed to a shoulder strap to which a purse (or other article) is removably attached in a manner that allows the purse to move, while attached, into an easy to access position.

DISCLOSURE OF THE INVENTION

It is accordingly one object of the present invention to provide a shoulder strap for securing an object thereto.

Another object of the present invention is to provide a shoulder strap for securing a purse thereto.

It is another object of the present invention to provide a shoulder strap for removably securing an object thereto.

A further object of the present invention is to provide a shoulder strap for removably securing a purse thereto.

A further object of the present invention is to provide a shoulder strap from which an object can be slidingly secured thereto.

An even further object of the present invention is to provide a shoulder strap from which a purse can be slidingly secured thereto.

A still further object of the present invention is to provide a shoulder strap from which an object can be slidingly and removably secured thereto.

A still further object of the present invention is to provide a shoulder strap from which a purse can be slidingly and removably secured thereto.

According to these and further objects of the present invention which will become apparent as the description thereof proceeds below, the present invention provides a small article carrier which includes:

a pair of shoulder straps which are connected together and form at least one lower loop that passes beneath an arm of a wearer;

a tether comprising an elongated member which is attached at opposite ends thereof to the at least one lower loop; and an article slidingly attached to the tether by means of connectors provided on the article through which connectors the tether freely passes.

The present invention further provides a small article carrier which includes:

a shoulder strap which forms a single loop that passes beneath an arm of a wearer;

a tether comprising an elongated member which is attached at opposite ends thereof to a lower portion of the loop; and an article slidingly attached to the tether by means of connectors provided on the article through which connectors the tether freely passes.

BRIEF DESCRIPTION OF DRAWINGS

The present invention will be described hereafter with reference to the attached drawings which are given as non-limiting examples only, in which.

BEST MODE FOR CARRYING OUT THE INVENTION

The present invention is directed to a shoulder strap by which a purse can be carried and easily accessed. Easy access to the purse is made possible by attaching the purse to the shoulder strap at a convenient location. That is, a location at which the wearer of the shoulder strap can easily reach the purse. Easy access to the purse is also made possible by attaching the purse to the shoulder strap in a removable manner. This allows the wearer to remove the purse from the shoulder strap, as desired, and access the contents thereof. Easy access is further made possible by attaching the purse to the shoulder strap by means of a tether along which the purse can slide into various positions.

The shoulder strap includes one or more upper loops which cross over one or both shoulders of the wearer. The shoulder strap also includes two lower loops which pass under each arm of the wearer. Alternatively, the shoulder strap may include one lower loop which passes under an arm of the wearer.

The lower loops are provided with means to attach the opposite ends of a tether thereto. The tether can be attached to the lower loops in a removable manner as discussed in more detail below.

The purse or other article to be carried is attached to the tether in a manner which allows the purse to slide along the tether. The purse can be attached to the tether in a permanent or a removable manner.

Figure 1:
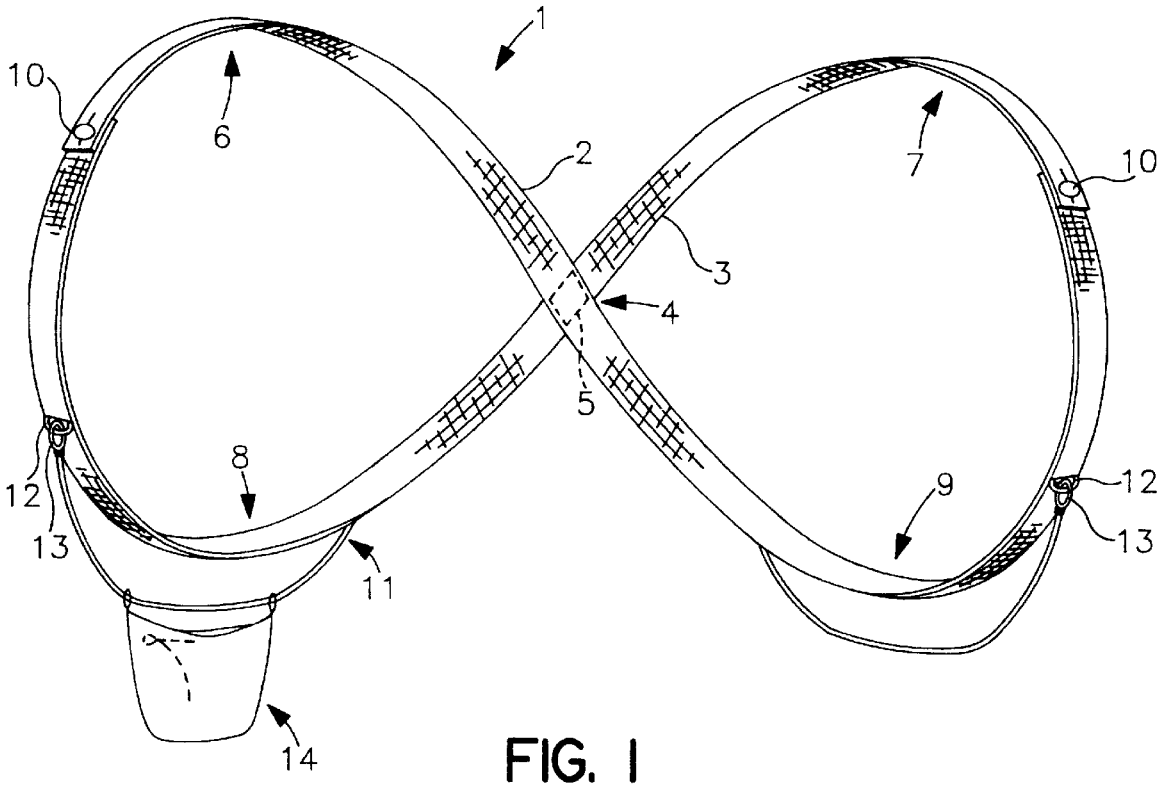
FIG. 1 is a front view of a shoulder strap according to one embodiment of the present invention.

FIG. 1 is a front view of a shoulder strap according to one embodiment of the present invention. As shown in FIG. 1 the shoulder strap, generally identified by reference numeral 1 includes a pair of strap members 2 and 3 which are arranged in a crossed relationship and permanently joined to one another in the parallelogram-shaped area 4. FIG. 1 depicts a pattern of stitches 5 which are used to join strap members 2 and 3 together. Alternative means to join the strap members 2 and 3 may include rivets, weldment portions (when the straps are made from a weldable synthetic material), or similar means. In addition to these permanent, non-adjustable means, strap members 2 and 3 may be joined together by non-permanent, adjustable means such as buttons, snaps, slots formed in one of the straps, slotted couplers, or the like.

The strap members 2 and 3 are connected at opposite ends to form a pair of upper loops 6 and 7 which pass over the shoulders of a wearer, and a pair of lower loops 8 and 9 which pass beneath the arms of a wearer. FIG. 1 depicts the strap members 2 and 3 as being connected at their opposite ends by a button 10. In alternative embodiments the ends of the strap members 2 and 3 may be connected by any suitable means including permanent connecting means, detachable connecting means, or adjustable connecting means. Examples of permanent connecting means include sewing or stitching, riveting, weaving, welding, gluing, etc. Examples of detachable connecting means include buttons, Velcro® (hook and fastener), hooks, snaps or the like. Examples of adjustable connecting means include buckles, adjustable clips, or the like.

The strap members 2 and 3 can be made from natural or synthetic fabrics, natural or synthetic leather, or any suitable non-rigid material. When made out of a light fiber such as cloth, a stiffening member may be included in the strap members 2 and 3 as desired to resist twisting of the strap members. In preferred embodiments, the device of the present invention is intended to be worn as an article of clothing, and therefore, various types of cloth fabrics with printed patterns or solid colors may be used to coordinate, complement, or accent other articles of clothing.

As depicted in FIG. 1, a tether 1 is provided on either or both lower loops 8 and 9. The tethers 11 are attached to the lower loops 8 and 9 so that they hang below the lower loops 8 and 9 as depicted. The tethers 11 can be lengths of cords, chains, wires, straps or the like along which an object can slide as discussed below. The tethers 11 are attached to the lower loops 8 and 9 by suitable connectors 12 such as rings, D-rings, eyelets, hooks, or equivalent means. The ends of the tethers 11 are preferably provided with detachable connectors 13 such as clasps, hooks, snap fasteners, clips, or the like, which can be removably attached to the connectors 12. This arrangement allows removal of one or both ends of the tethers 11 and thus removal of the purse 14 from the shoulder strap 1. Alternatively, the ends of the tethers 11 could include connectors 13 that permanently connect to the connectors 12 on the lower loops 8 and 9.

Figure 3:
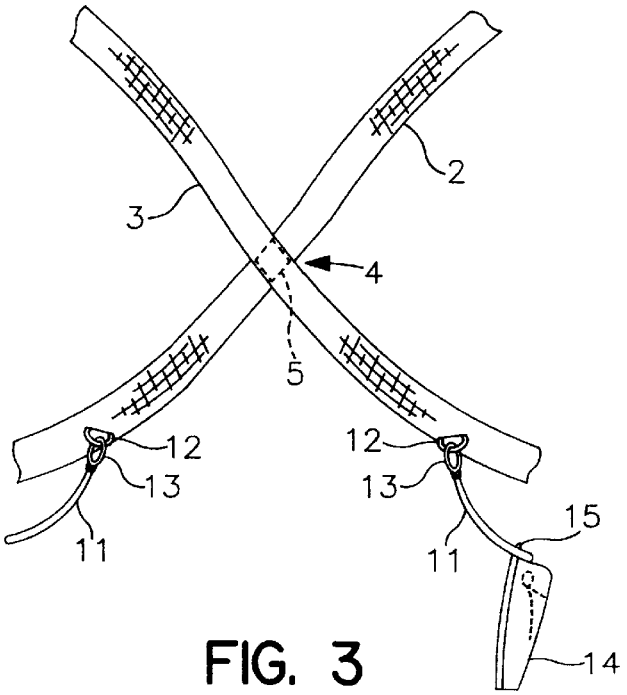
FIG. 3 is a detail of the back of the shoulder strap of FIG. 1 which depicts the means to attach the tether to the lower loops.
Figure 2:
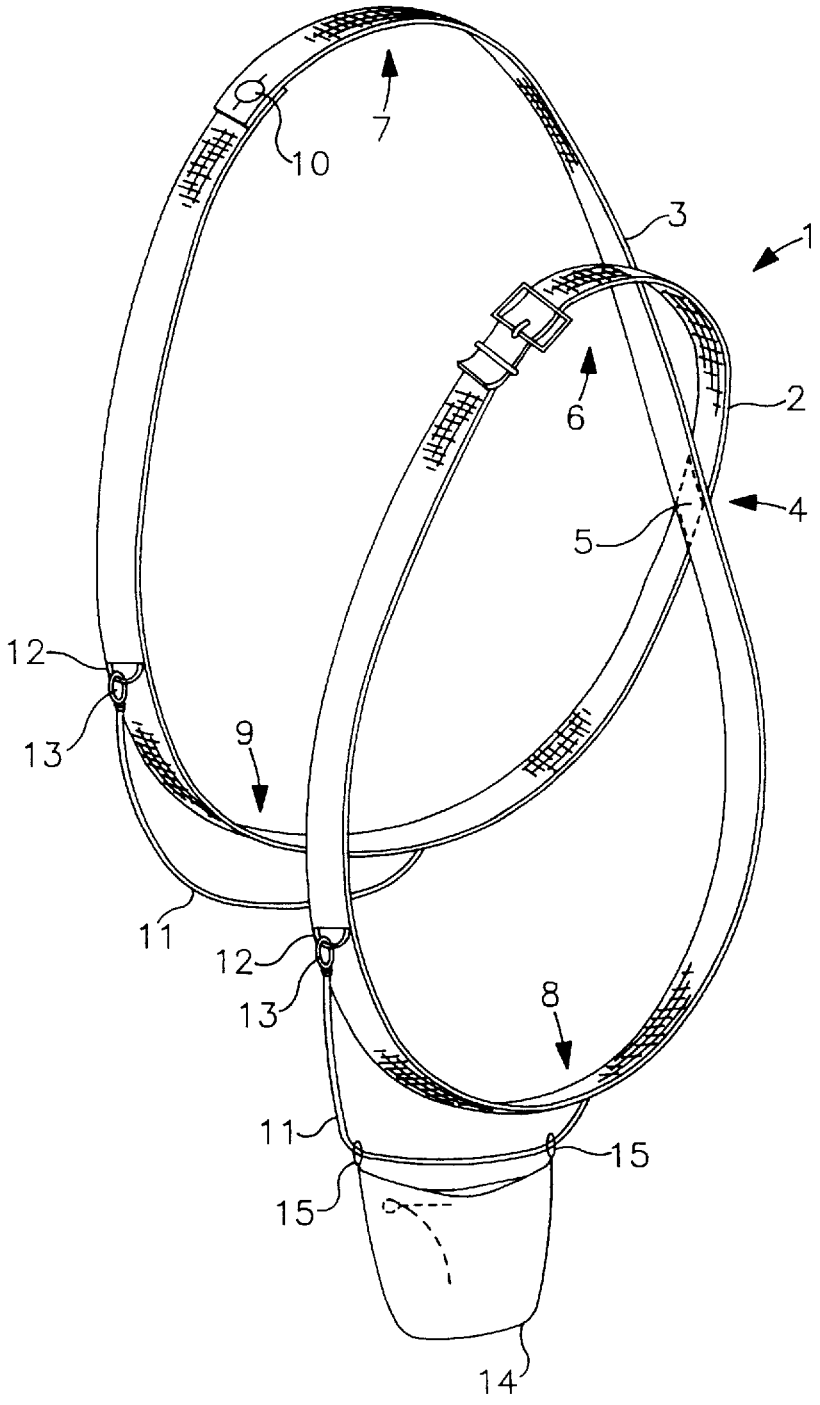
FIG. 2 is a perspective view of the shoulder strap of FIG. 1.

A purse 14 (or other article) is slidingly attached to one or both of the tethers 11 as depicted in FIGS. 1–3, by means of rings 15 through which the tether 11 can pass and freely slide. Rings 15 may be circular, D-rings, eyelets, hooks or equivalent devices which provide the sliding function. Alternatively, the rings 15 could comprise such devices as clasps, hooks, snap fasteners, clips, or the like, which allow the purse 14 to be removed from the tether 11 without removing the tether 11 from the lower loop 8.

The purse 14 is preferably a soft bag-like structure having an opening at the top which can be closed by means of a zipper, snaps, Velcro®, or other suitable closure means. The purse 14 can be made from natural or synthetic fabrics, natural or synthetic leather, or any other suitable material. The purse 14 may be of any typical design, so long as it includes rings 15 for slidable attachment to the tether 11. In alternative embodiments, the shoulder strap 1 of the present invention is not limited to carrying a purse. That is, other articles such as small radios, pouches, etc. could be slidingly attached to the tether 11 for easy access by the wearer. In addition, although not depicted in the figures, two purses (or other articles) could be carried by attaching them to each of the tethers 11. Also, multiple tethers of the same of varying lengths could be attached to either of the lower loops for attaching thereto several purses or other articles.

FIG. 2 is a perspective view of the shoulder strap of FIG. 1. FIG. 2, best depicts how the purse 14 would be suspended from the tether 11 when the device is worn by a person. As can be seen from FIG. 2, the purse 14, which would normally be positioned beneath an arm of the wearer, can be grasped and slid along tether 11 toward the front of the device so that a person wearing the device can access the purse 14. Alternatively, the front end of the tether 11 can be disconnected from the lower loop 8 and the purse 14, can be slide off of the tether 11 to access the purse 14 or the contents thereof.

FIG. 3 is a detail of the back of the shoulder strap of FIG. 1 which depicts the means to attach the tether to the lower loops.

Figure 4:
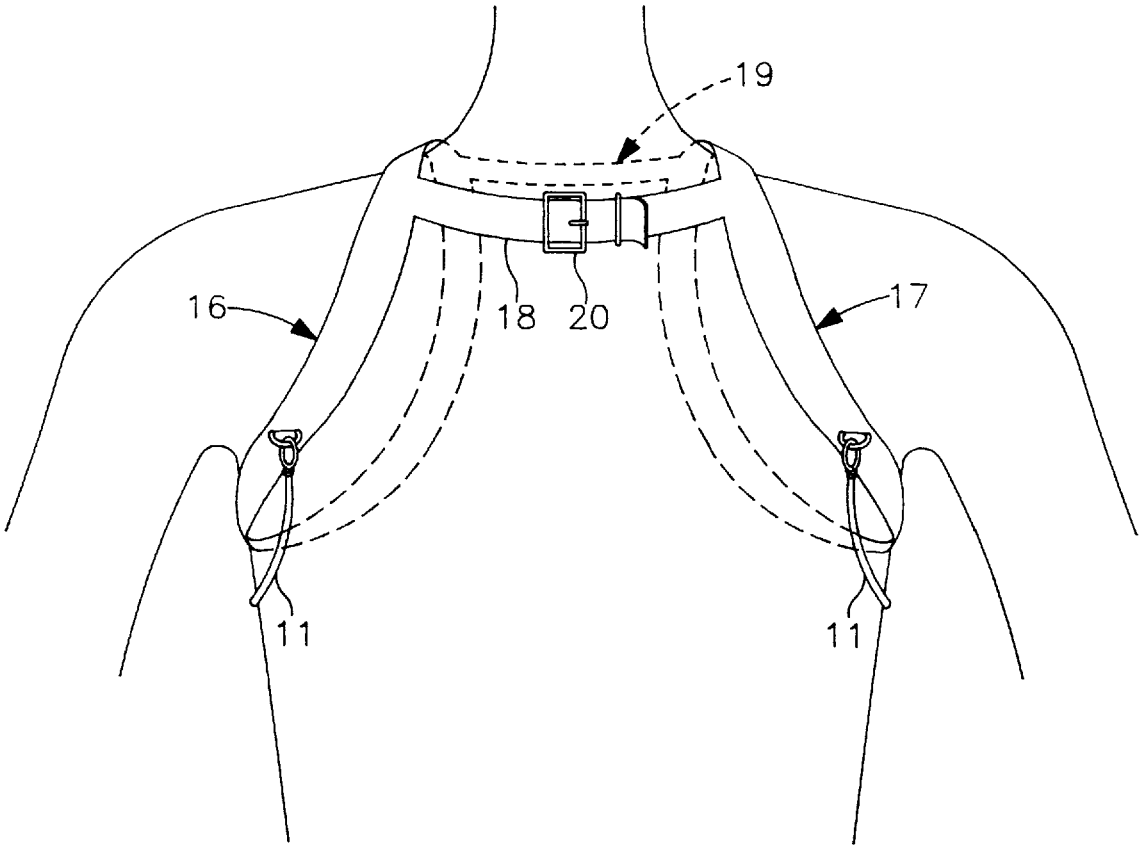
FIG. 4 is a front view of an alternative embodiment of the shoulder strap.

FIG. 4 is a front view of an alternative embodiment of the shoulder strap. In the embodiment of the invention depicted in FIG. 4, the shoulder strap 1 does not crisscross in the back. Instead, this embodiment includes two loops 16 and 17 which are connected together in the front and back by cross pieces 18 and 19. The cross pieces are located at the base of the neck of the wearer as depicted in FIG. 4, so as to prevent the loops 16 and 17 from sliding off the wearer's shoulders. The front cross piece 18 is provided with an adjustable buckle 20 which allows the front cross piece 18 to be opened for putting on or taking off the device. The buckle 20 could be replaced with Velcro®, a series of snaps or buttons, or similar means to open and adjust the cross piece 18. Likewise, the loops 16 and 17 could be provided with similar adjusting means. Tethers 11 are depicted in FIG. 4 as being attached to lower portions of loops 16 and 17 and passing beneath the arms of the wearer. The means for attaching the tether 11 to the lower portions of loops 16 and 17, and the means for attaching a purse to tethers 11 can be the same as those discussed above in reference to FIGS. 1–3.

Figure 5:
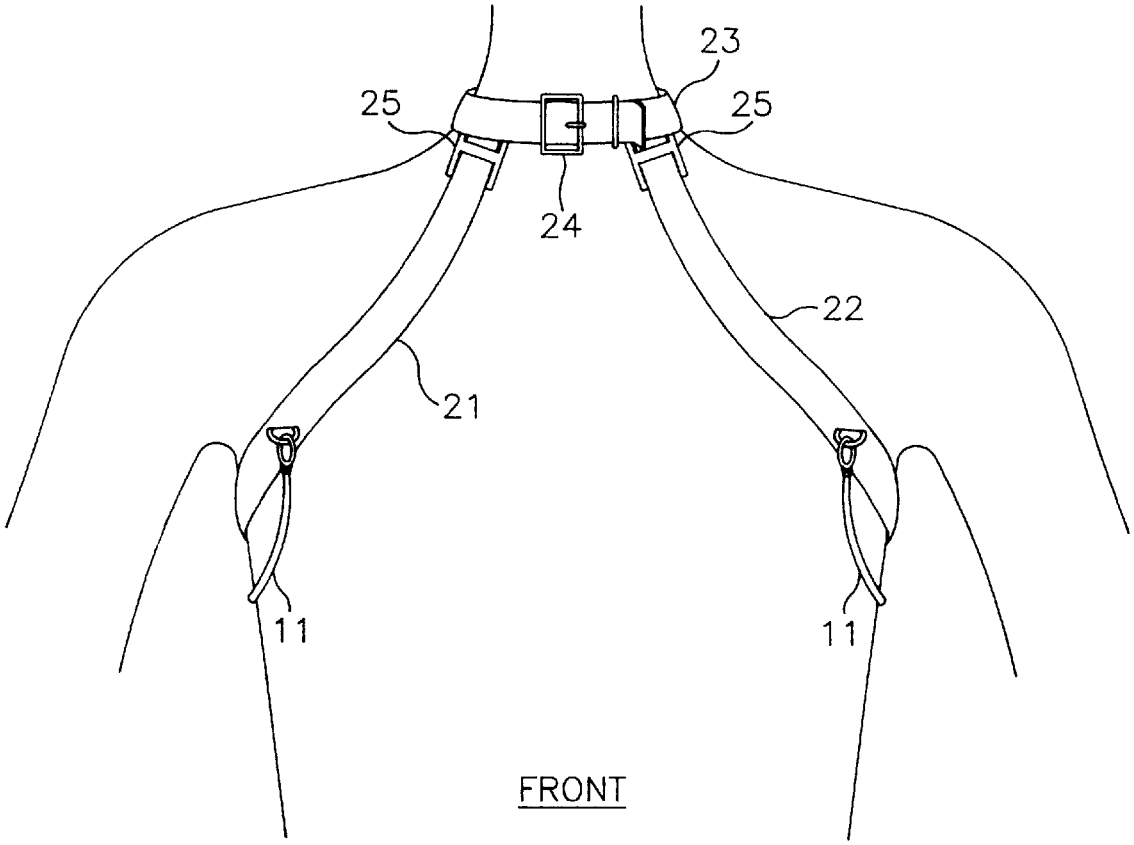
FIG. 5 is a front view of another alternative embodiment of the shoulder strap.

FIG. 5 is a front view of another alternative embodiment of the shoulder strap. The embodiment of the invention shown in FIG. 5 is similar to that of FIG. 4, except that the pair of loops 21 and 22 are connected to a collar 23 which fits around the neck of the wearer. As depicted, the collar 23 includes a buckle 24 which allows the collar to be opened and adjusted. The buckle 23 can be similar to that used in FIG. 4. Alternatively, any of the alternative means discussed above in reference to buckle 20 could be used in place of buckle 24. Similarly the loops 21 and 22 could be provided with adjusting means as discussed above. Tethers 11 are depicted in FIG. 5 as being attached to lower portions of loops 21 and 22 and passing beneath the arms of the wearer. The means for attaching the tether 11 to the lower portions of loops 21 and 22, and the means for attaching a purse to tethers 11 can be the same as those discussed above in reference to FIGS. 1–3

Figure 6:
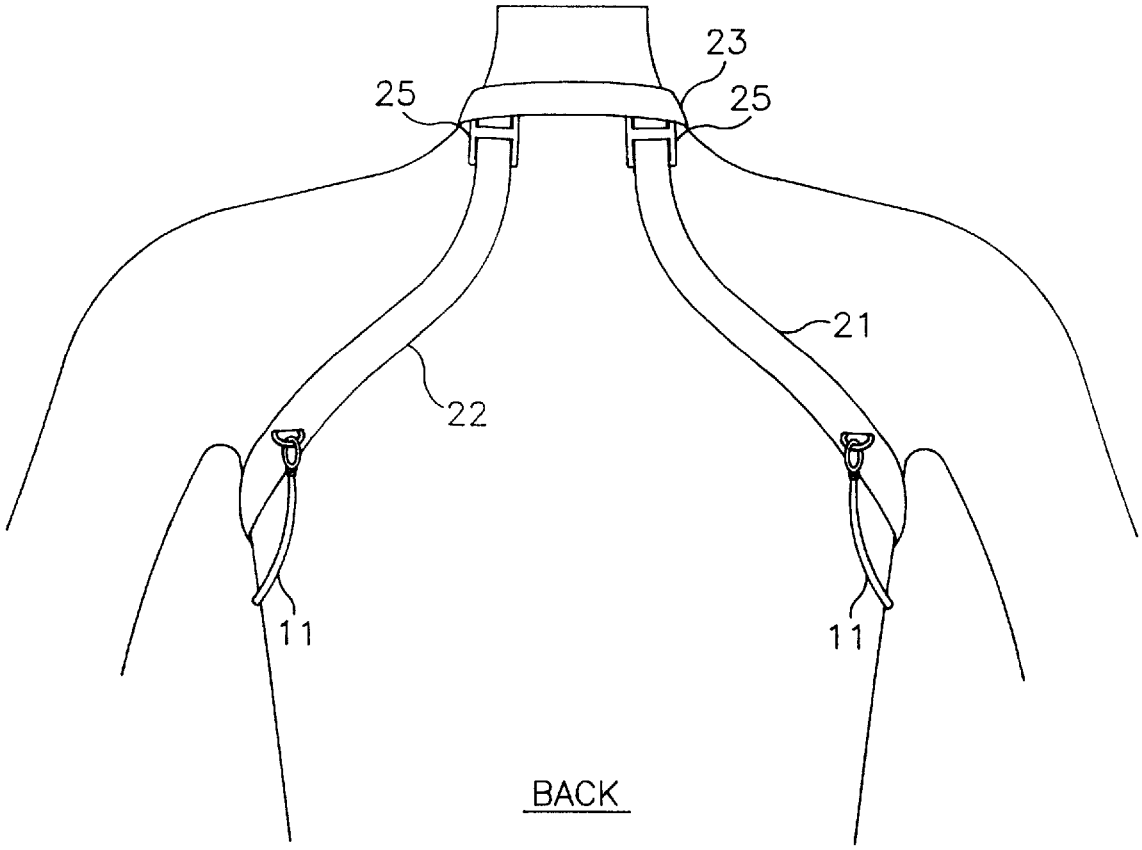
FIG. 6 is a back view of the shoulder strap of FIG. 5.

FIG. 6 is a back view of the shoulder strap of FIG. 5. As shown in FIGS. 5 and 6 the loops 21 and 22 can be attached to collar 23 by means of connectors 25 which are attached to collar 23. Loops 21 and 22 can be permanently attached to connectors 25, for example by the ends of the loops. Alternatively, folding over and sewing connectors 25 may include means to receive and grip the ends of loops 21 and 22 whereby the ends of the loops are adjustably secured to connectors 25. Connectors 25 may comprise buckles which have gripping structures or buckles similar to those depicted in FIGS. 4 or 5.

In an alternative to the embodiment shown in FIGS. 5 and 6, the shoulder strap of the present invention could have a single loop that extends over and beneath an arm of the wearer.

The embodiments of the invention depicted in FIGS. 4–6 can be made out of the same materials as discussed above in reference to FIGS. 1–3.

Although the present invention has been described with reference to particular means, materials and embodiments, from the foregoing description, one skilled in the art can easily ascertain the essential characteristics of the present invention and various changes and modifications may be made to adapt the various uses and characteristics without departing from the spirit and scope of the present invention as described by the claims which follow.

What is claimed:

1. A small article carrier comprising:

a pair of shoulder straps which are connected together and form at least one closed lower loop that passes beneath an arm of a wearer;

a tether comprising an elongated member which is attached at opposite ends thereof to the at least one lower loop; and an article connected to the tether by means of connectors provided on the article through which connectors the tether freely passes, whereby the article can slide freely along the tether and is suspended by the tether in a spaced apart relationship from the at least one lower loop, said at least one lower loop and said article being nonconnectable to one another upon incidental contact.

2. A small article carrier according to claim 1, wherein the shoulder straps crisscross at one point and are connected together at the point where they crisscross.

3. A small article carrier according to claim 1, wherein the tether is attached to the at least one lower loop by a detachable connector.

4. A small article carrier according to claim 2, wherein the tether is attached to the at least one lower loop by a detachable connector.

5. A small article carrier according to claim 1, wherein the article is a purse.

6. A small article carrier according to claim 1, wherein the tether comprises a length of chain.

7. A small article carrier according to claim 1, wherein the at least one lower loop comprises a means for adjusting a length of the loop.

8. A small article carrier according to claim 7, wherein the means for adjusting the length of the lower loop comprises a buckle.

9. A small article carrier according to claim 1, wherein the at least one lower loop comprises two lower loops.

10. A small article carrier according to claim 1, wherein the pair of shoulder straps are connected together at opposite ends.

11. A small article carrier according to claim 10, wherein the pair of shoulder straps are connected together at opposite ends by an adjustable means.

* * * * *